US005664975A

United States Patent [19]

Carlisle

[11] Patent Number: 5,664,975

[45] **Date of Patent: *Sep. 9, 1997**

[54] REFLECTIVE PROPELLER SAFETY COVER

[76] Inventor: William L. Carlisle, 3408 Peppermint Dr., Hopkinsville, Ky. 42240

[ * ] Notice: The terminal 21 months of this patent has been disclaimed.

[21] Appl. No.: 314,097

[22] Filed: Sep. 28, 1994

[51] Int. Cl.[6] ..... B63H 1/14

[52] U.S. Cl. ..... 440/49; 150/154

[58] Field of Search ..... 440/49, 71, 113, 440/900; 150/154, 166, 167; 416/61, 62, 146 R; 116/30; D15/4

[56] References Cited

U.S. PATENT DOCUMENTS

| | | | |
|---|---|---|---|
| D. 265,947 | 8/1982 | Nienstaedt | D3/52 |
| D. 288,744 | 3/1987 | Taylor | D3/106 |
| D. 333,663 | 3/1993 | Faber | D15/4 |
| 1,666,099 | 4/1928 | Kingman | 150/154 |
| 1,869,313 | 7/1932 | Mackay | 150/154 |
| 4,664,649 | 5/1987 | Johnson et al. | 493/197 |
| 4,993,978 | 2/1991 | Johannes | 440/71 |
| 5,135,222 | 8/1992 | Spector | 150/154 |
| 5,273,399 | 12/1993 | Ojeda | 416/146 R |
| 5,282,502 | 2/1994 | Bauard | 150/167 |
| 5,293,975 | 3/1994 | Howorka | 150/154 |

*Primary Examiner*—Stephen Avila

[57] ABSTRACT

A reflective propeller safety cover comprising a bag having a flat bottom wall and a side wall peripherally coupled thereto and extended therefrom to define a hollow interior sized for holding a propeller of an motor boat and a mouth for allowing access to the interior for receiving a propeller; an adjustable coupling mechanism coupled to the bag for adjustably opening and closing the mouth; and a reflector mechanism coupled to the bottom wall of the bag for providing a visual indication when light is shined thereupon.

1 Claim, 4 Drawing Sheets

FIG 3
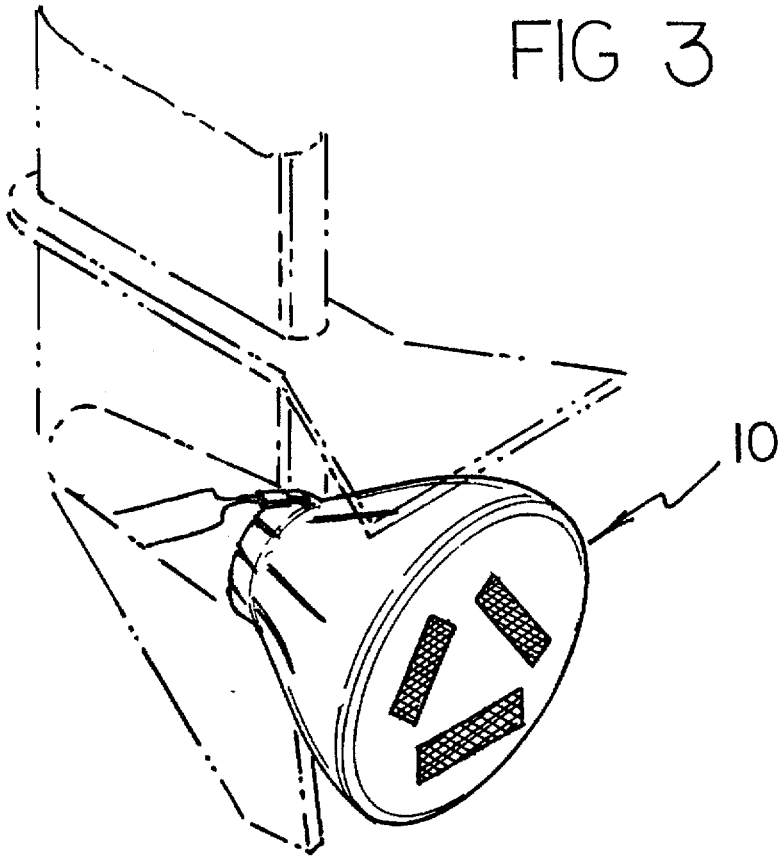
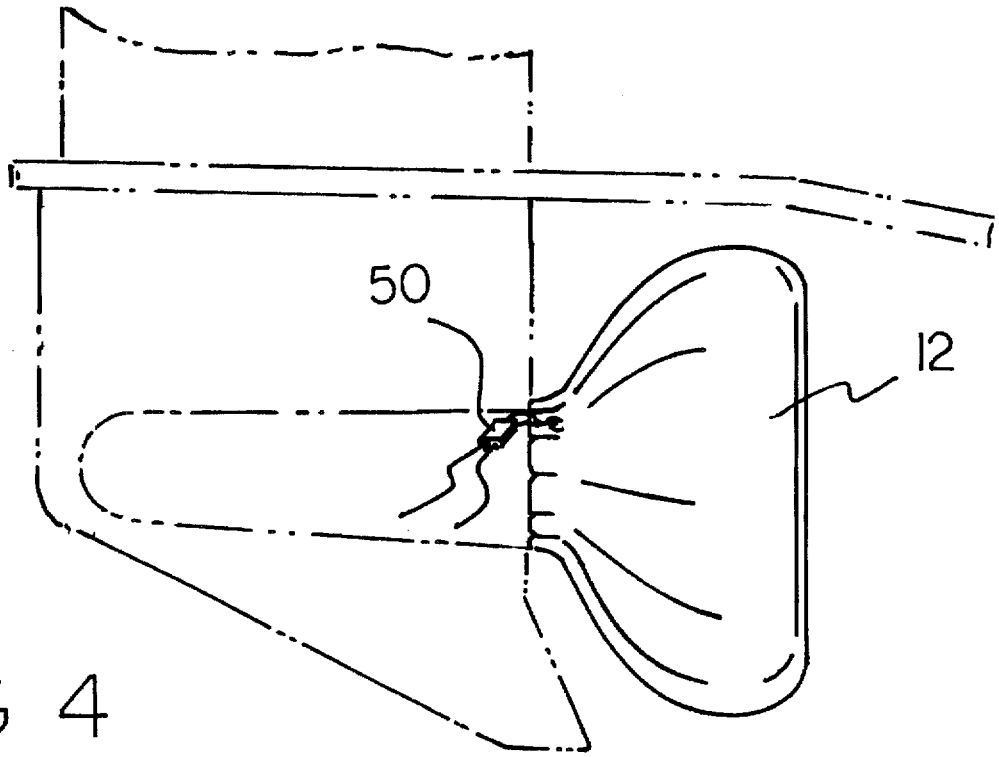
FIG 4

REFLECTIVE PROPELLER SAFETY COVER

BACKGROUND OF THE INVENTION

1. Field of the Invention

The present invention relates to a reflective propeller safety cover and more particularly pertains to attaching over a propeller of a motor boat being towed by a trailer for preventing rear-end accidents from occurring with a reflective propeller safety cover.

2. Description of the Prior Art

The use of propeller covers is known in the prior art. More specifically, propeller covers heretofore devised and utilized for the purpose of covering propellers of boats are known to consist basically of familiar, expected and obvious structural configurations, notwithstanding the myriad of designs encompassed by the crowded prior art which have been developed for the fulfillment of countless objectives and requirements.

By way of example, U.S. Pat. No. Design 265,947 to Nienstaedt discloses a pouch. U.S. Pat. No. Design 288,744 to Taylor discloses a money pouch. U.S. Pat. No. Design 333,663 to Faber discloses a propeller cover for an outboard motor. U.S. Pat. No. 4,664,649 to Johnson et al. discloses a method and apparatus of producing a drawstring bags. U.S. Pat. No. 5,273,399 to Ojeda discloses a reflective propeller cover.

While these devices fulfill their respective, particular objective and requirements, the aforementioned patents do not describe a reflective propeller safety cover that prevents rear-end accidents from occurring and has a side door for allowing the bag to be drained and for allowing a propeller disposed within the bag to be dried.

In this respect, the reflective propeller safety cover according to the present invention substantially departs from the conventional concepts and designs of the prior art, and in doing so provides an apparatus primarily developed for the purpose of attaching over a propeller of a motor boat being towed by a trailer for preventing rear-end accidents from occurring.

Therefore, it can be appreciated that there exists a continuing need for new and improved reflective propeller safety cover which can be used for attaching over a propeller of a motor boat being towed by a trailer for preventing rear-end accidents from occurring. In this regard, the present invention substantially fulfills this need.

SUMMARY OF THE INVENTION

In the view of the foregoing disadvantages inherent in the known types of propeller covers now present in the prior art, the present invention provides an improved reflective propeller safety cover. As such, the general purpose of the present invention, which will be described subsequently in greater detail, is to provide a new and improved reflective propeller safety cover and method which has all the advantages of the prior art and none of the disadvantages.

To attain this, the present invention essentially comprises, in combination, a bag formed of a fluorescent orange cloth material. The bag has a generally circular flat bottom wall and a side wall integrally coupled to the periphery of the bottom wall and extended therefrom to terminate at an edge. The side wall and bottom wall of the bag thereby define a hollow interior sized for holding a propeller of an motor boat. The edge of the bag thereby defines a mouth for allowing access to the interior for receiving a propeller. The edge of the bag is turned back upon itself and secured to the side wall to create an annular channel. The side wall of the bag includes a lower portion and an upper portion with the lower portion having a generally concave shape as referenced with respect to the interior and with the upper portion having a generally convex shape as referenced with respect to the interior. The side wall of the bag includes a generally rectangular aperture disposed therethrough for allowing the bag to be drained and a propeller disposed within the interior of the bag to be dried. The side wall of the bag includes a flap secured thereto adjacent to the aperture and thus creates a door. The side wall of the bag includes a pile type fastener secured about the periphery of the aperture. A complimentary pile type fastener is secured about the periphery of the door. The fasteners are coupled together in one position to prevent access to the interior of the bag through the aperture and the fasteners are decoupled from each other in another position to allow access to the interior of the bag through the aperture.

A drawstring is included and disposed within the channel to define an adjustable loop. The ends of the drawstring are extended from the channel and through the side wall. The loop formed by the drawstring is adjustable in a tightened configuration for preventing access to the interior of the bag. The loop formed by the drawstring is also adjustable in a loosened configuration for allowing access to the interior of the bag. A slide lock is included and slidably secured to the free ends of the drawstring for setting the adjustment of the loop. Lastly, a plurality of reflective tape strips are coupled to the bottom wall of the bag for providing a visual indication when light such as from headlights is shined thereupon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved reflective propeller safety cover which has all the advantages of the prior art propeller covers and none of the disadvantages.

It is another object of the present invention to provide a new and improved reflective propeller safety cover which may be easily and efficiently manufactured and marketed.

It is a further object of the present invention to provide a new and improved reflective propeller safety cover which is of durable and reliable construction.

An even further object of the present invention is to provide anew and improved reflective propeller safety cover which is susceptible of a low cost of manufacture with regard to both materials and labor, and which accordingly is then susceptible of low prices of sale to the consuming public, thereby making such a reflective propeller safety cover economically available to the buying public.

Still yet another object of the present invention is to provide a new and improved reflective propeller safety cover which provides in the apparatuses and methods of the prior art some of the advantages thereof, while simultaneously overcoming some of the disadvantages normally associated therewith.

Even still another object of the present invention is to provide a new and improved reflective propeller safety cover for attaching over a propeller of a motor boat being towed by a trailer for preventing rear-end accidents from occurring.

Lastly, it is an object of the present invention to provide a new and improved reflective propeller safety cover comprising a bag having a flat bottom wall and a side wall peripherally coupled thereto and extended therefrom to define a hollow interior sized for holding a propeller of an motor boat and a mouth for allowing access to the interior for receiving a propeller; adjustable coupling means coupled to the bag for adjustably opening and closing the mouth; and reflector means coupled to the bottom wall of the bag for providing a visual indication when light is shined thereupon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the preferred embodiment constructed in accordance with the principles of the present invention secured to a propeller of an motor boat.

FIG. 4 is a side elevational view of the preferred embodiment secured to a propeller of an motor boat.

The same reference numerals refer to the same parts through the various Figures.

DESCRIPTION OF THE PREFERRED EMBODIMENT

Figure 1:
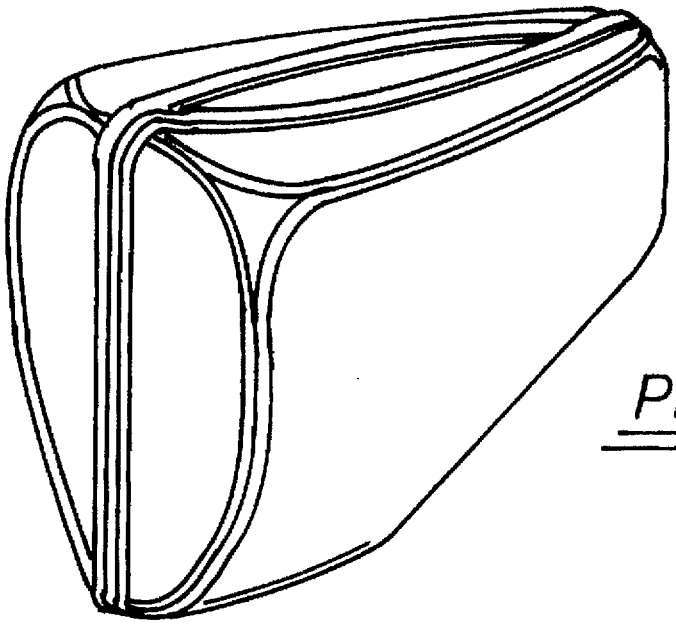
FIG 1 PRIOR ART
FIG. 1 is a perspective view of a prior art propeller motor for an outboard motor.
Figure 2:
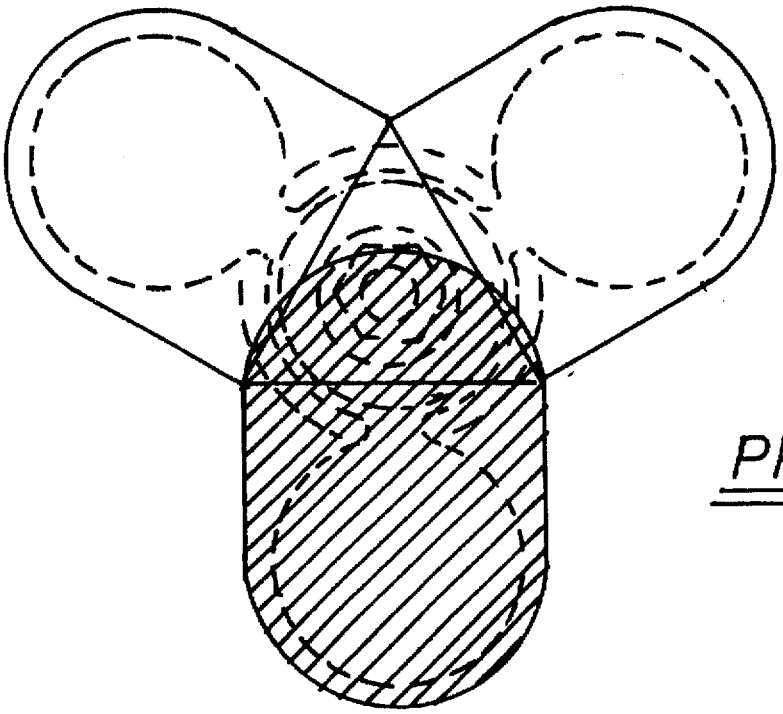
FIG 2 PRIOR ART
FIG. 2 is a side elevational view of a prior art reflective propeller cover.
Figure 5:
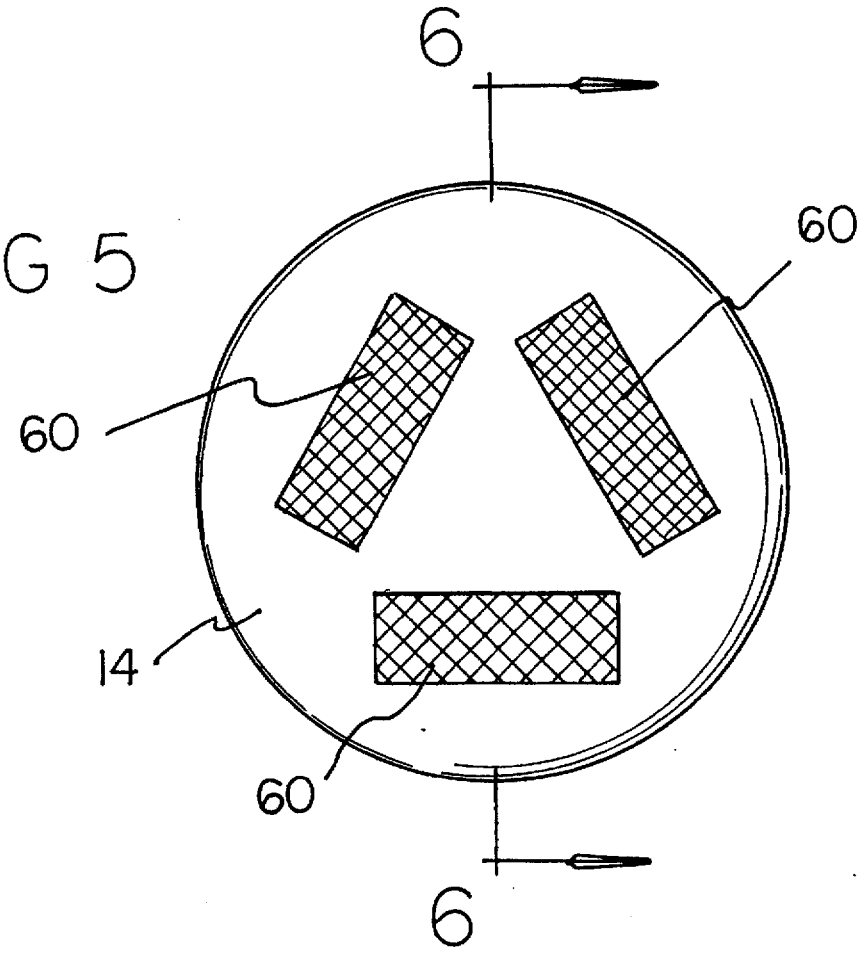
FIG. 5 is yet another side elevational view of the present invention depicting the reflector strips thereupon.

With reference now to the drawings, and in particular, to FIG. 1 thereof, the preferred embodiment of the new and improved reflective propeller safety cover embodying the principles and concepts of the present invention and generally designated by the reference number 10 will be described.

Specifically, the present invention includes four major components. The major components are the bag, drawstring, slide lock, and reflective tape strips. These components are interrelated to provide the function of preventing rear-end accidents when the present invention is secured over a propeller of a motorboat.

Figure 6:
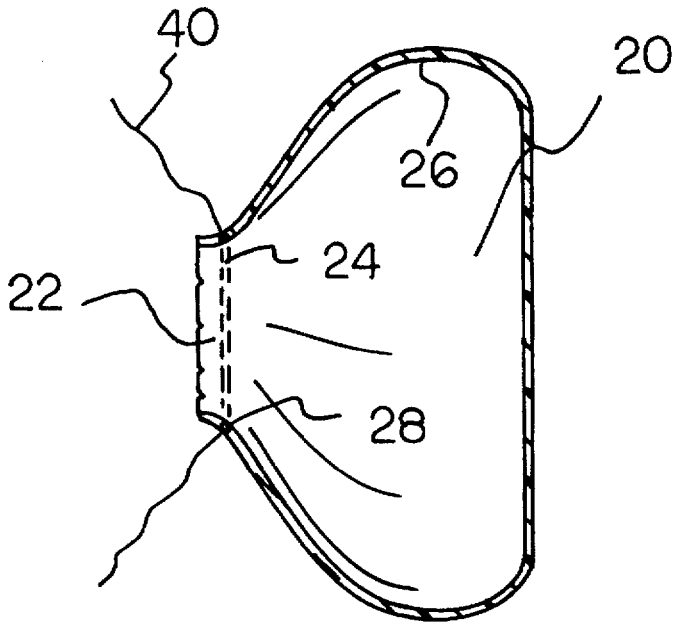
FIG. 6 is a cross-sectional view of the present invention taken along the line 6—6 of FIG. 5.
Figure 7:
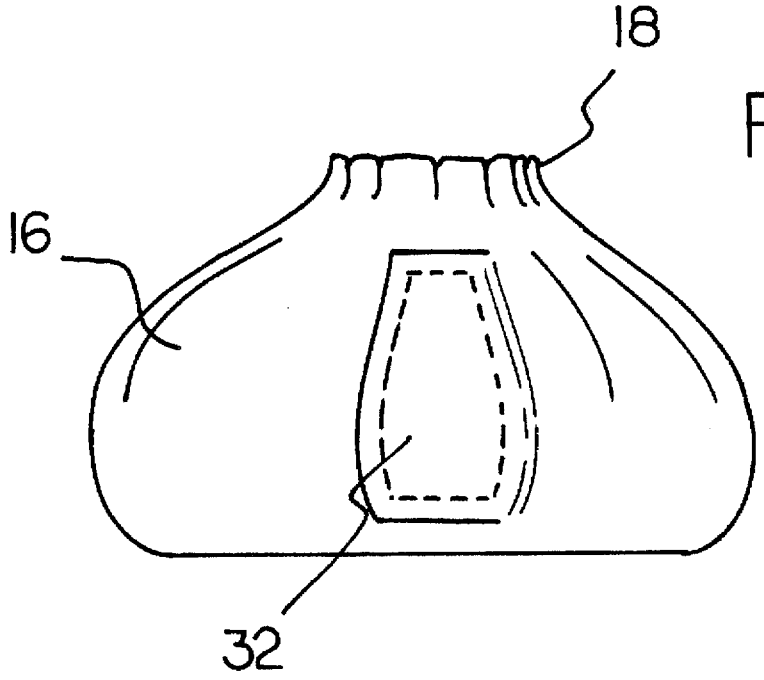
FIG. 7 is still yet another side elevational view of the present invention depicting the door for allowing access to the interior for allowing drainage of the bag and drying of the propeller.
Figure 8:
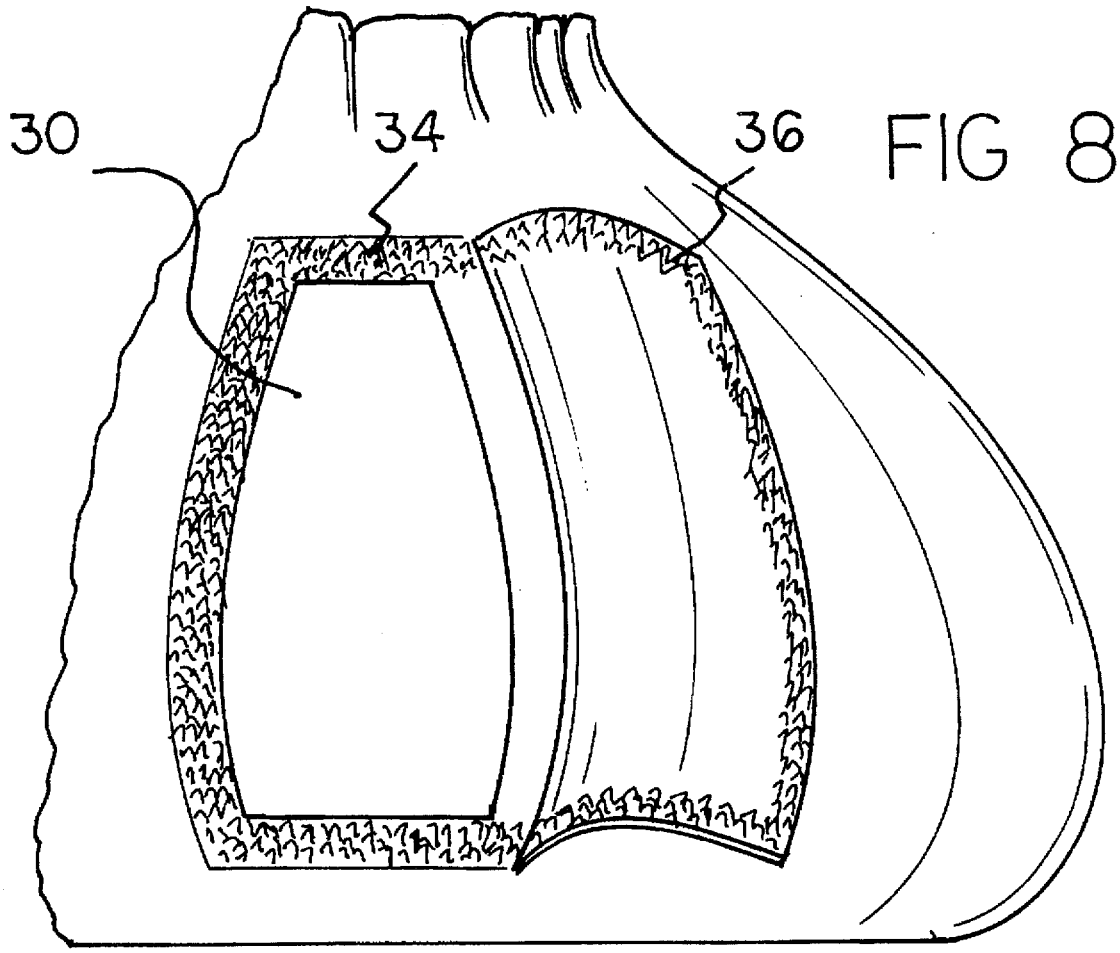
FIG. 8 is an enlarged side elevational view of the present invention with its door opened.

More specifically, it will be noted in the various Figures that the first major component is the bag 12. The bag is formed of a fluorescent orange cloth material. The bag has a central axis and a generally circular flat bottom wall 14 and a side wall 16 integrally coupled to the periphery of the bottom wall. The side wall is extended from the bottom wall to terminate at an edge 18. As shown in FIG. 4, the bag has a fixed axial length as defined between the bottom wall 14 and the edge 18 along the central axis and an exterior diameter that is about 72% greater than the fixed axial length. The side wall and bottom wall of the bag thereby define a hollow interior 20. This interior is sized for holding the propeller of a motorboat. The edge of the bag thereby defines a mouth 22. The mouth allows access to the interior of the bag for receiving a propeller. The edge of the bag is further turned back upon itself and secured to the side wall to create an annular channel 24 adapted to receive a drawstring therein. The side wall further includes a lower portion 26 and an upper portion 28. The lower portion is located adjacent to the bottom wall and has a generally concave shape as referenced with respect to the interior. As shown by the cross section of the bag in FIG. 6, the lower portion of the side wall has a larger radius of curvature than the upper portion of the side wall. The upper portion is positioned adjacent to the mouth and has a generally convex shape as referenced with respect to the interior. The side wail of the bag includes a generally rectangular aperture 30 disposed therethrough. This aperture allows the bag to be drained. This aperture also allows a propeller disposed within the interior of the bag to be air dried. The bag also includes a flap secured adjacent to the aperture and thus creates a door 32. The door has a pair of parallel side edges and an end edge extended therebetween. The bag also includes a pile type fastener 34 secured about the periphery of the aperture and a complimentary pile type fastener 36 secured about the periphery of the door. The pile type fasteners are coupled together in one position to close the door and thus prevent access to the interior of the bag through the aperture. The fasteners are also decoupled from each other in another position to open the door and thus allow access to the interior through the aperture.

The second major component is the drawstring 40. The drawstring is elongated and flexible in structure and has two free ends. The drawstring is disposed within the channel 24 to thereby define an adjustable loop between the ends. The ends of the drawstring are extended from the channel at an adjacent location through the side wall. The loop formed by the drawstring is adjustable in a tightened configuration around the mouth for closing the mouth and thus preventing access to the interior of the bag. The loop formed by the drawstring is also adjustable in a loosened orientation for opening the mouth and thus allowing access to the interior of the bag.

The third major component is the slide lock 50. The slide lock is formed of an elastomeric type material. The slide lock is slidably secured to the free ends of the drawstring. The slide lock is slidable upon the drawstring and is used for setting and locking the adjustment of the loop in a tightened orientation or a loosened orientation.

The fourth major component is the reflective tape strips 60 the present invention includes a plurality of reflective tape strips. The reflective tape strips are coupled to the bottom wall of the bag. The reflective tape strips provide a visual indication when light is shined thereupon to thereby indicate the presence of the bag.

The present invention serves as a safety marker which attaches over the propeller of a motorboat when the motorboat is towed on a trailer for preventing rear-end accidents. The present invention resembles a cloth bag with drawstrings. The bag is of a florescent orange color so that it may be easily seen in daylight. Light reflective tape is also stitched on or adhered to the bottom wall of the bag to reflect light from headlights so that it may be easily seen when driving at night. The present invention can be made in several sizes to accommodate various motor boat propeller sizes.

To utilize the present invention, the mouth of the bag is opened and placed over a propeller of an outboard motor of a boat. The bag is then secured by pulling on the drawstrings to close the mouth around the propeller shaft. The slide lock is then pushed up against the bag to ensure that the bag stays securely coupled to the propeller. The drawstrings are then tied around the propeller shaft of the motor so that the present invention will not blow off when driving. Simply untie the drawstrings, push back the slide lock, and remove the present invention before placing the motor in water. The present invention is very easy to apply and remove. The florescent orange color of the bag and reflective tape thereon make it highly visible at all times. The present invention effectively signals drivers who might not otherwise notice that the propeller protrudes dangerously from a towed trailer. The present invention signals drivers not to tailgate, thus helping to prevent rear-end accidents.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A reflective propeller safety cover for attaching over a propeller of a motor boat being towed by a trailer for preventing rear-end accidents from occurring comprising, in combination:

a bag formed of a fluorescent orange cloth material, the bag having a central axis, a generally circular flat bottom wall and a side wall integrally coupled to the periphery of the bottom wall and extended therefrom to terminate at an edge and with the bag having a fixed axial length as defined between the bottom wall and the edge along the central axis and an exterior diameter that is about 72% greater than the fixed axial length, the side wall and bottom wall thereby defining a hollow interior sized for holding a propeller of a motor boat, the edge thereby defining a mouth for allowing access to the interior for receiving a propeller and with the edge further turned back upon itself and secured to the side wall to create an annular channel, the side wall further having a lower portion and an upper portion with the lower portion having a generally concave shape as referenced with respect to the interior and with the upper portion having a generally convex shape as referenced with respect to the interior and with the lower portion of the side wall having a larger radius of curvature than the upper portion of the side wall, the side wall additionally having a generally rectangular aperture disposed therethrough for allowing the bag to be drained and a propeller that is disposed within the interior of the bag to be dried, a flap having a pair of parallel side edges and an end edge extended therebetween secured adjacent to the aperture and positionable therover to create a door, a pile type fastener secured about the periphery of the aperture, and a complimentary pile type fastener secured about the periphery of the door and with the fasteners coupled together in one position to prevent access to the interior through the aperture and the fasteners decoupled from each other in another position to allow access to the interior through the aperture;

a drawstring disposed within the channel to define an adjustable loop and with its ends extended from the channel and through the side wall, the loop adjustable in a tightened configuration for preventing access to the interior and the loop adjustable in a loosened configuration for allowing such access;

a slide lock slidably secured to the free ends of the drawstring for setting the adjustment of the loop; and a plurality of reflective tape strips coupled to the bottom wall of the bag for providing a visual indication when light is shined thereupon.

* * * * *